US011453522B2

(12) United States Patent
Tissmer et al.

(10) Patent No.: US 11,453,522 B2
(45) Date of Patent: Sep. 27, 2022

(54) METHOD FOR SHAPING THE BOTTOM OF HOT-FILLED CONTAINERS

(71) Applicant: KRONES AG, Neutraubling (DE)

(72) Inventors: Bastian Tissmer, Regensburg (DE); Ulrich Lappe, Neutraubling (DE); Arno Haner, Wiesent (DE); Jochen Hirdina, Regensburg (DE); Andreas Wutz, Roding (DE); Gerald Huettner, Vilseck (DE)

(73) Assignee: KRONES AG, Neutraubling (DE)

( * ) Notice: Subject to any disclaimer, the term of this patent is extended or adjusted under 35 U.S.C. 154(b) by 332 days.

(21) Appl. No.: 16/074,701

(22) PCT Filed: Dec. 15, 2016

(86) PCT No.: PCT/EP2016/081266
§ 371 (c)(1),
(2) Date: Aug. 1, 2018

(87) PCT Pub. No.: WO2017/144139
PCT Pub. Date: Aug. 31, 2017

(65) Prior Publication Data

US 2019/0039768 A1 Feb. 7, 2019

(30) Foreign Application Priority Data

Feb. 25, 2016 (DE) ..... 10 2016 202 908.8

(51) Int. Cl.
*B65B 61/24* (2006.01)
*B67C 3/04* (2006.01)
(Continued)

(52) U.S. Cl.
CPC ..... *B65B 61/24* (2013.01); *B65B 3/00* (2013.01); *B65D 79/0081* (2020.05);
(Continued)

(58) Field of Classification Search
CPC ... B65B 61/24; B65B 2220/24; B65B 9/2049; B65D 79/005
(Continued)

(56) References Cited

U.S. PATENT DOCUMENTS 4,880,129 A * 11/1989 McHenry ..... B65D 81/18 53/425
5,090,180 A * 2/1992 Sorensen ..... B29C 51/426 53/329.3
5,585,125 A * 12/1996 Iizuka ..... B29C 49/6481 264/520
8,127,955 B2 * 3/2012 Denner ..... B65D 79/005 215/373
(Continued)

FOREIGN PATENT DOCUMENTS

DE 102009060655 A1 6/2011
GN 104416893 A 3/2015
(Continued)

OTHER PUBLICATIONS iSA European Patent Office, International Search Report Issued in Application No. PCT/EP2016/081266, DATED Feb. 17, 2017, WIPO, 4 pages.

*Primary Examiner* — Robert F Long
*Assistant Examiner* — Xavier A Madison
(74) *Attorney, Agent, or Firm* — McCoy Russell LLP

(57) ABSTRACT

A method is described for shaping the bottom of hot-filled containers, in which the bottoms of the containers are forced inwardly from a state bulged outwardly, in particular as they cool down. Complex mechanisms for forcing the bottom inwardly are dispensable for the reason that the bottoms are forced inwardly by at least one fluid jet and/or fluid pressure wave. In addition, shaping the bottom can advantageously be carried out in a production region immediately downstream of a closer.

16 Claims, 3 Drawing Sheets

(51) Int. Cl.

| | |
|---|---|
| ***B67C 7/00*** | (2006.01) |
| ***B67C 3/22*** | (2006.01) |
| ***B65B 3/00*** | (2006.01) |
| ***B65D 79/00*** | (2006.01) |
| *B65B 55/04* | (2006.01) |
| *B65B 7/16* | (2006.01) |

(52) U.S. Cl.
CPC ..... *B67C 3/045* (2013.01); *B67C 3/22* (2013.01); *B67C 7/0086* (2013.01); *B65B 7/16* (2013.01); *B65B 55/04* (2013.01); *B65B 2220/24* (2013.01); *B67C 7/00* (2013.01); *B67C 2003/226* (2013.01)

(58) Field of Classification Search
USPC ..... 53/477
See application file for complete search history.

(56) References Cited

U.S. PATENT DOCUMENTS

| | | | | |
|---|---|---|---|---|
| 8,794,462 | B2 * | 8/2014 | Trude | B29C 49/08 215/370 |
| 2007/0084821 | A1 * | 4/2007 | Bysick | B65D 1/0284 215/373 |
| 2009/0293436 | A1 | 12/2009 | Miyazaki et al. | |
| 2014/0026522 | A1 * | 1/2014 | Melrose | B65D 1/0284 53/440 |
| 2015/0069669 | A1 * | 3/2015 | Dachs | B29C 49/64 264/523 |

FOREIGN PATENT DOCUMENTS

| | | | |
|---|---|---|---|
| JP | 2008100720 | A | 5/2008 |
| WO | 2005012091 | A2 | 2/2005 |
| WO | 2010129402 | A1 | 11/2010 |
| WO | 2013139874 | A1 | 9/2013 |

* cited by examiner

METHOD FOR SHAPING THE BOTTOM OF HOT-FILLED CONTAINERS

CROSS-REFERENCE TO RELATED APPLICATIONS

The present application is a U.S. National Phase of International Patent Application Serial No. PCT/EP2016/081266 entitled "METHOD FOR SHAPING THE BOTTOM OF HOT-FILLED CONTAINERS," filed on Dec. 15, 2016. International Patent Application Serial No. PCT/EP2016/081266 claims priority to German Patent Application No. 10 2016 202 908.8, filed on Feb. 25, 2016. The entire contents of each of the abovementioned applications are hereby incorporated by reference in their entirety for all purposes.

TECHNICAL FIELD

The invention relates to a method for shaping the bottom of hot-filled containers and a corresponding production system for hot-filling containers.

BACKGROUND AND SUMMARY

Hot-filling beverages or the like into containers is typically carried out at product temperatures of 70 to 95° C. When cooling the filled and sealed containers, a negative pressure is created therein due to the volume of air present in the headspace of the containers. In particular thin-walled plastic containers thereby deform inwardly.

For controlled deformation of plastic containers, it is known that vacuum compensation surfaces, so-called panels, can be integrated into the side wall of the containers. Such compensation surfaces can be undesirable for reasons of design and/or impede labeling on the side walls. Therefore, so-called panel less bottles have been proposed which have no vacuum compensation surfaces on their side walls.

In this regard, WO 2010/129402 A1 describes a panel less bottle with a bottom membrane which is drawn inwardly to a final target position solely by the negative pressure arising when during the cooling down process. However, membranes or similar thin-walled bottom regions in use typically do not comprise the desired dimensional stability and/or mechanical resistance.

WO 2013/139874 A1 alternatively proposes to mechanically force the bottom of a panel less bottle inwardly with the aid of a punch, while the bottle is clamped between a turntable and a centering bell. Shaping the bottom, also referred to as bottom activation, however, requires a complicated lifting mechanism in the turntable. In addition, shaping the bottom then takes place in the region of a labeling machine or the like, i.e. at a comparatively late point in time, after the containers have largely cooled down. In the meantime, however, the containers may have already deformed in an undesirable manner.

The containers are also handled in the non-activated state of the bottom until the bottom has been shaped. This makes reliable transport, for example, of containers standing upright more difficult and/or requires appropriately adapted transport devices.

It would therefore be desirable to shape the bottom of panel less bottles or similar containers within the meaning of compensatory bottom activation with the least possible equipment complexity and/or as early as possible after filling and closing.

This object posed is satisfied with a method used to shape bottoms of hot-filled containers, such as bottles. The containers are preferably made of plastic material. The bottoms of the hot-filled containers are forced inwardly, in particular as they cool down from a state bulged outwardly. According to the invention, the bottoms are forced inwardly by at least one fluid jet and/or one fluid pressure wave. The bottoms of the containers are there transformed from a so-called inactivated state to a so-called activated state.

The bottom activation is carried out according to the invention in a fluidic manner without any element forcing the bottoms inwardly, such as a punch, a negative mold of the bottom or the like. The fluid jet and/or the fluid pressure wave can be directed towards the bottoms of the containers, basically irrespective of the orientation of the containers, for example in an upright orientation, lying orientation or upside down orientation of the containers.

The state of the bottoms bulging outwardly is produced, for example, during stretch blow molding of the containers. The state bulging outwardly is preferably a quasi-stable state that does not change when handling the empty containers, when filling the containers, and when closing the containers. Only with the selective action of fluid pressure from the outside onto the bottom does the latter transform to a state bulged inwardly.

The bottoms are preferably forced inwardly by a jet of water, in particular a jet of cooling water. As a result, the bottoms can be forced inwardly in a production step immediately downstream of where the containers are closed, in particular during neck sterilization, or, for example, when the containers are recooled. A desired cooling effect and the activation of the container bottom can be effected simultaneously, in particular, with a jet of cooling water.

The bottoms are forced inwardly preferably by a jet of compressed air. Jets of compressed air can be directed at the containers flexibly in different sections of filling systems, for example, during the transfer or transport of the containers between individual treatment stations. A jet of compressed air could be used advantageously, for example, in the section of neck sterilization of the containers.

The bottoms are forced inwardly preferably by a shock wave. For example, such fluid pressure waves can be transmitted to the container bottoms by water and a flexible membrane made of rubber or the like applied to the bottoms. Suitable shock wave generators operate, for example, according to the principle of a lithotripter.

Preferably, the fluid jet and/or the fluid pressure wave are directed onto the bottoms while the containers are in a lying orientation and in particular while being transported. The bottoms can then be forced inwardly in a simple manner, in particular in the region of neck sterilization. The activation of the bottoms then takes place immediately after the containers have been closed. The likelihood of problems arising wile the containers are transported with non-activated bottoms and/or the containers becoming permanently deformed in an undesirable manner on their sidewalls then decreases.

Preferably, the fluid jet and/or the fluid pressure wave are directed onto the bottoms while the containers are in an upright orientation and in particular while being transported. The containers can then be acted upon from below with at least one fluid jet and/or at least one fluid pressure wave while being suspended or standing upright on a longitudinally divided conveyor belt. Transporting the containers in a suspended or upright manner is practicable, for example, in the region of a container recooler.

The containers are during the action of the fluid jet and/or the fluid pressure wave preferably fixed from above by an abutment acting axially and therefore in the longitudinal direction of the containers. This prevents the containers from lifting off a conveyor belt or the like during the action of the fluid jet and/or the fluid pressure wave, and in particular prevents the containers from falling over.

The fluid jet and/or the fluid pressure wave are preferably directed onto the bottoms while the containers are transported upside down. As a result, the fluid jet and/or the fluid pressure wave is not counteracted by any liquid pressure from above. Delivering the fluid jet and/or the fluid pressure wave from above is both space-saving and advantageous for servicing.

The fluid jet and/or the fluid pressure wave are preferably directed onto the bottoms in the region of a neck sterilizer. The activation of the bottoms then takes place particularly early, substantially directly after the containers have been closed. Potential complications due to transport errors with inactivated bottoms as well as the risk of permanent uncontrolled deformation of the container can be minimized thereby.

The fluid jet and/or the fluid pressure wave are preferably directed onto the bottoms in the region of a container recooler. In particular, when using at least one jet of water, cooling the filled container and activating the container bottom can be achieved simultaneously. In addition, a fluid jet can be generated in the region of a container recooler with particularly low equipment complexity.

The containers are preferably panel less bottles made of plastic material. Such bottles can then be shaped with particularly thin side walls and/or labeled and/or have a print applied in a flexible manner. As a result, plastic material can be saved and the freedom of design in terms of possible container shapes and labels can be expanded.

Shaping the bottom preferably causes a reduction in volume of the container and thereby compensates negative pressure in the containers by at least 50%, in particular at least 75%, which is induced by the hot-filled and closed containers cooling down. Undesired deformation of the container side walls can be prevent thereby.

This object posed is likewise satisfied with a production system used for hot-filling containers and comprises a filler and treatment machines and transport sections for the containers arranged downstream of the filler. A pressurized fluid source for at least one fluid jet and/or one fluid pressure wave is arranged in the region of at least one of the treatment machines and/or transport sections for performing the method according to at least one of the preceding embodiments.

The bottoms of the containers can therewith be activated in a flexible manner at suitable locations of the production system and in a gentle manner. Furthermore, the location of the bottom activation can be adapted to the requirements of container transportation. This is to be understood to mean that an undesirable restriction or impairment of container transportation due to still inactivated bottoms can be specifically prevented, both in an upright orientation of the containers as well as in a lying orientation or upside down.

The pressurized fluid source for the at least one fluid jet and/or the at least one fluid pressure wave is preferably arranged in the region of a neck sterilizer and/or in the region of a container recooler. The activation of the bottoms can then be carried out at a comparatively high temperature, in particular prior to further or final cooling of the containers. The bottoms are more flexible at an elevated temperature of the plastic material and can be activated with less fluid pressure. Furthermore, permanent uncontrolled deformation of the containers, in particular in their side wall area, can be prevented in that the activation of the bottom takes place as early as possible after the containers have been closed.

In addition, fluids in the region of neck sterilizers and/or container recoolers can be applied particularly easily. For example, jets of water in the region of the container recooler can be directed without problems at the containers and the jetted water can again be easily collected.

Preferred embodiments of the invention are illustrated in the drawings, where

Figure 1A:
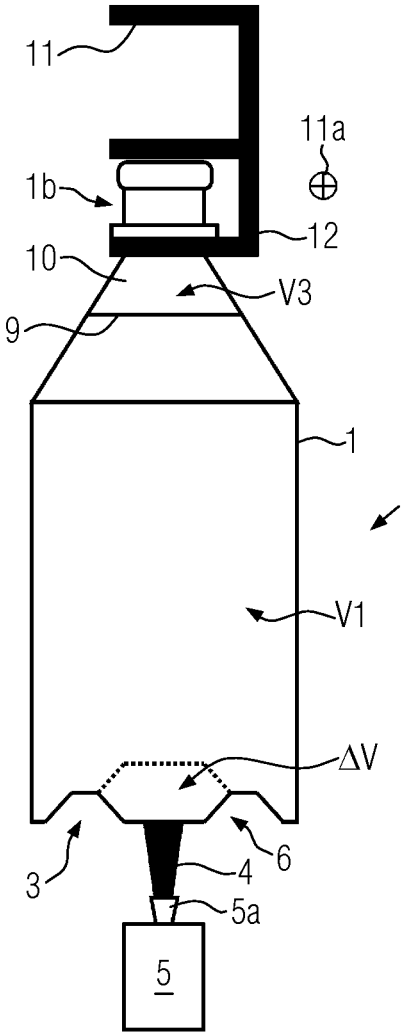
FIGS. 1A and 1B show a schematic representation of the method for shaping the bottoms.
Figure 1B:
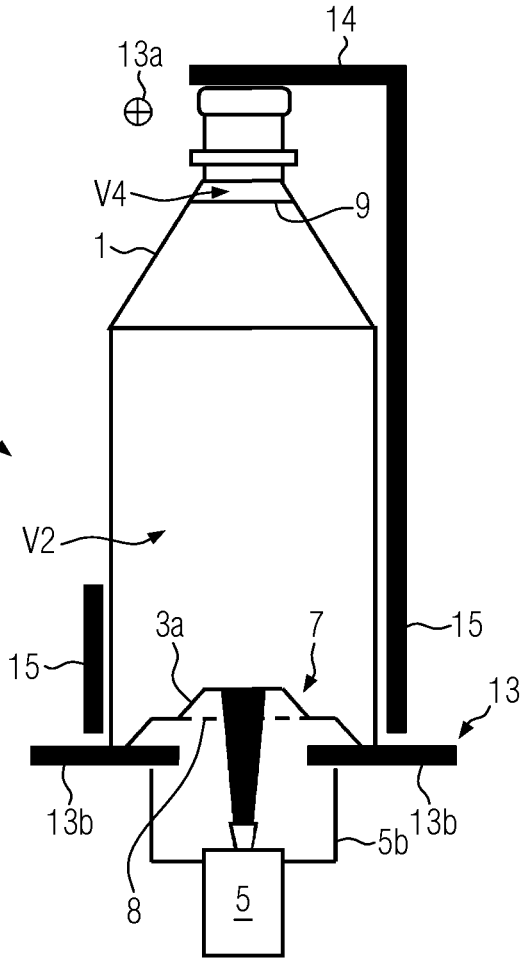

As can be seen from FIGS. 1A and 1B, the method according to the invention for shaping the bottom of hot-filled containers 1 can be performed, for example, in an upright orientation 2 and in particular during transportation of containers 1. For this purpose, bottom 3 of container 1 is acted upon with a fluid jet 4 from below from a pressurized fluid source 5. Fluid jet 4 can be, for example, a jet of water which is directed onto bottom 3 of container 1 by use of a nozzle 5*a* of pressurized fluid source 5. Water ricocheting from bottom 3 can be collected with a collection tray 5*b* which is preferably also configured as a spray-water protection, or a similar collection device.

DETAILED DESCRIPTION

In FIG. 1A, bottom 3 is in a state 6 bulged outwardly prior to the method according to the invention having been performed. Whereas, FIG. 1B shows bottom 3 in a state 7 forced inwardly and in particular completely shaped after the method has been performed. Outer state 6 can also be referred to as the inactivated state of bottom 3, the inner and in particular completely shaped state 7 as the activated state. The complete activation of bottom 3 is in principle also possible in several partial steps and/or in different system regions.

Outer state 6 can be referred to as a quasi-stable state, which is dimensionally stable, when handling empty container 1 and when filling and closing container 1, without selective activation of bottom 3, i.e. without the action of an external overpressure onto bottom 3. Completely shaped bottom 3 has a final shape intended for later use.

As indicated schematically in FIG. 1A, the transition between outer state 6 and inner state 7 of bottom 3 takes place in that an in particular central section 3*a* of bottom 3 is forced inwardly from a quasi-stable outer position. It can be sufficient that fluid jet 4 forces bottom 3 inwardly only up to an unstable intermediate position 8 and bottom 3, starting from intermediate position 8, automatically transitions to inner state 7, see FIG. 1B. For example, elastic over-forcing of central section 3*a* is possible beyond a dead center that is present at intermediate position 8, with the result of a subsequent automatic inward bulging of section 3*a* up to inner state 7.

Container 1 has a volume V1 prior to being hot-filled and a volume V2 after the bottom has been shaped. The compensatory reduction in volume AV=V1−V2 for compensating for a negative pressure in closed container 1 is created by the transition from outer state 6 to inner state 7.

A hot-filled liquid product 9 is present in closed container 1. Before carrying out the method according to the invention, a partial volume V3 of container 1 is filled with, in particular, air 10 that is still hot above product 9. After the method has been performed, a comparatively smaller partial volume V4 with air 10 remains above product 9. The compensatory reduction in volume AV compensates for a pressure drop caused by air 10 cooling down above product 9. The volume change of product 9 when cooling down can there be approximately neglected.

In FIG. 1A, fluid jet 4 is directed onto bottoms 3 during off-bottom transportation of containers 1. For this purpose, containers 1 are moved by a transport device 11 in a direction of transport 11*a* and are there suspended in an off-bottom manner in supports 12 which simultaneously serves as the upper axial abutment for the action of fluid jet 4. Supports 12 grip containers 1, for example, in neck region 1*b*.

As is evident from FIG. 1B, containers 1 can alternatively stand on a transport device 13 which, for example, comprises two conveyor belts 13*b* running in a direction of transport 13*a*. Fluid jet 4 can then be directed between the two conveyor belts 13*b* onto bottoms 3.

The axial freedom of movement of containers 1 is preferably limited upwardly by a separate axial abutment 14 to avoid containers 1 from being excessively lifted from transport device 13 or even from dropping over. Abutment 14 could be, for example, a stationary slide rail or a belt or the like actively or passively running along with containers 1. Lateral stationary guide rails 15 or lateral belts running along can likewise be present.

Fluid jet 4 can be emitted cyclically by at least one stationary pressurized fluid source 5 as bottom 3 passes through the working area of pressurized fluid source 5. Several pressurized fluid sources 5 can also be present successively in the direction of transport 11*a*, 13*a* in order to effect the transition between outer state 6 and inner state 7 in stages and/or for several containers 1 simultaneously.

When shaping the bottom, pressurized fluid source 5 could run along with containers 1 over a predetermined transport section in the direction of transport 11*a*, 13*a* or even several pressurized fluid source 5 each for one container 1. This can increase the exposure time of fluid jet 4 and/or the latter can be selectively directed onto section 3*a* of bottom 3 to be activated. For this purpose, at least one pressurized fluid source 5 could, for example, oscillate in and against the direction of transport 11*a*, 13*a*.

Fluid jet 4 can be a jet of water, a jet of compressed air or a different jet of gas. Jets of water have the advantage of less noise and better cooling effect over jets of compressed air. Suitable collection devices for the discharged water are, for example, collection trays 5*b* or the like in the region of container recoolers and neck sterilizers.

Figure 2:
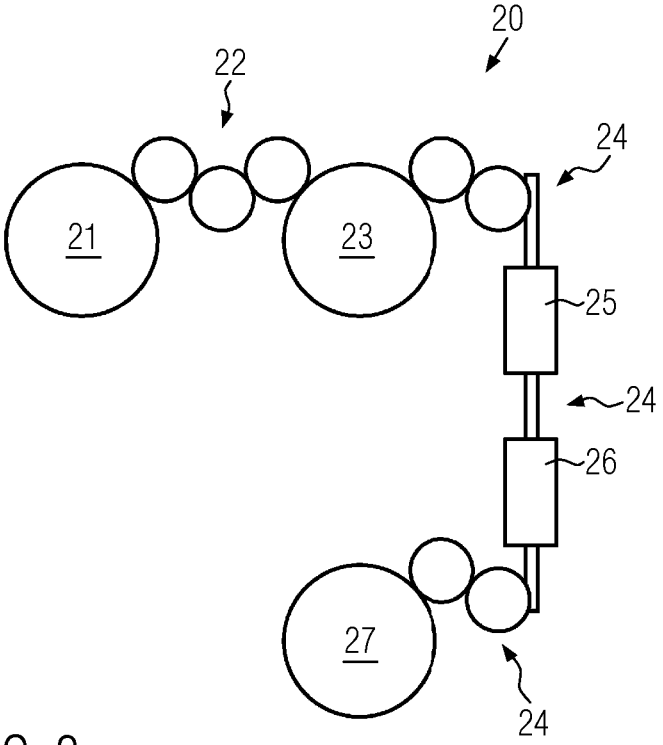
FIG. 2 shows a schematic representation of a production system for hot-filling containers.

FIG. 2 schematically shows a production system 20 for hot-filling containers 1.

According thereto, containers 1 are filled in a filler 21 with hot product 9 and transferred to a closer 23 by way of a transport section 22, which comprises, for example, at least one transfer star and/or linear conveyors.

Containers 1 closed therein are transferred to a neck sterilizer 25 by way of a transport section 24 which, for example, comprises at least one transfer star and/or a linear conveyor. Containers 1 are therein taken to a lying orientation in a known manner or transported upside down to sterilize neck portion 1 *b* of container 1 with the still hot product 9.

Containers 1 thus treated are subsequently fed by way of a further transport section 24 to a container recooler 26 in which containers 1 are cooled down to a temperature that is suitable for further processing, for example, to room temperature.

Finally, cooled down containers 1 can be transferred by way of a further transport section 24 to a labeling machine 27 or the like for processing.

In the region of neck sterilizer 25, fluid jet 4 can consist both of cooling water and of water with a suitable temperature, so as not to impede the neck sterilization process. Also conceivable is a fluid jet 4 consisting of compressed air.

At least one fluid jet 4 for performing the method, for example, in the form of tempered water, cooling water or compressed air, could be directed onto containers 1 also in the region of transport sections 24 downstream of closer 23.

In the region of container recooler 26, fluid jet 4 is preferably provided in the form of cooling water. In this way, bottoms 3 can be shaped in a compensating manner and containers 1 can be recooled in an economical manner. Due to the collection trays for water or the like necessary for recooling containers 1, only a low equipment complexity arises with the application of fluid jet 4.

For performing the method, transport sections 24, neck sterilizer 25 and/or container recooler 26 are encapsulated preferably in a housing and/or equipped with collection trays 5*b* or the like, for example, for sound insulation and/or for splash water protection.

Figure 3:
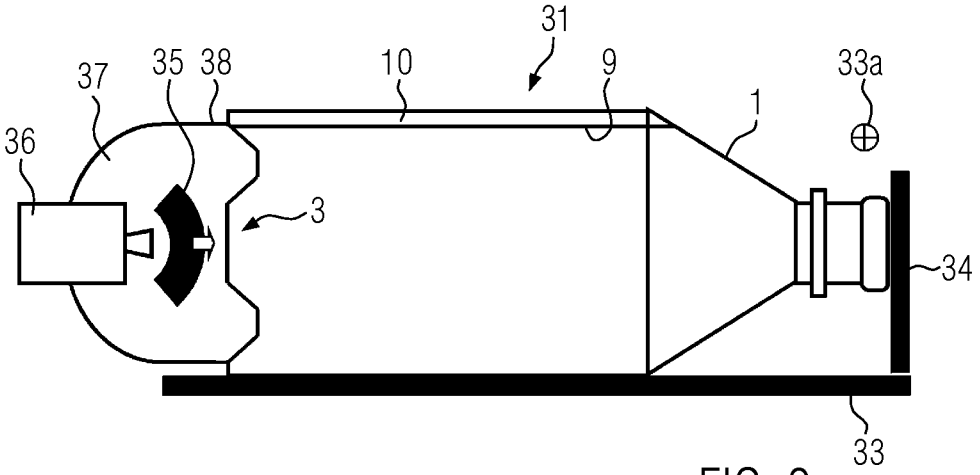
FIG. 3 shows an alternative embodiment for shaping the bottoms of containers disposed in a lying orientation.
Figure 4:
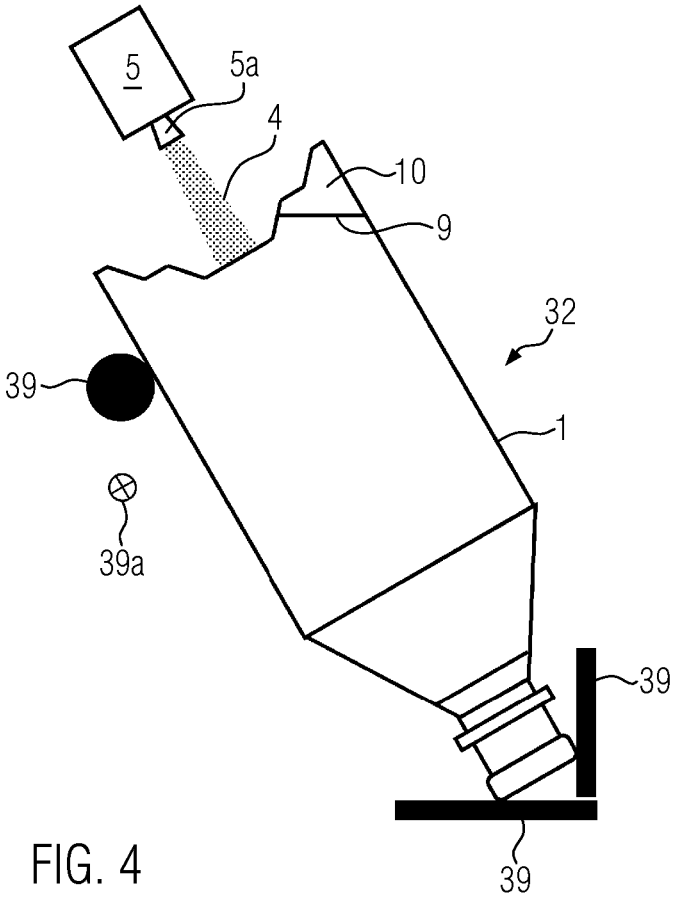
FIG. 4 shows an alternative embodiment for shaping the bottoms of containers disposed upside down.

As is evident from FIGS. 3 and 4, the neck sterilization of containers 1 can take place in a lying orientation 31 of containers 1 or upside down. Upside down is to be understood such that the mouth portion of containers 1 either points vertically downwardly or has an oblique downwardly pointing orientation 32, as shown by way of example in FIG. 4. Transportation and recooling of containers 1 is basically possible in any orientation 2, 31 and/or 32.

FIG. 3 schematically illustrates the transportation of containers 1 in the region of neck sterilizer 25. For this purpose, containers 1 are disposed in a lying orientation on a conveyor belt 33 and stabilized axially by a lateral abutment 34. Abutment 34 could be a stationary sliding plate as well as a belt or the like running along in the direction of transport 33*a*.

As an alternative to fluid jet 4, a fluid pressure wave 35 can be directed onto bottom 3 with the aid of a shock wave generator 36. Shock wave generator 36 can be formed, for example, similar to a lithotripter, and direct fluid pressure wave 35 through a water reservoir 37 and a flexible membrane 38 onto bottom 3.

FIG. 4 further illustrates a container 1 which is in an orientation 32 standing inclined upside down when the method is performed. Fluid jet 4 is in the example of FIG. 4 alternatively indicated schematically as a jet of compressed air. The jet of compressed air is emitted, for example, from a nozzle 5*a* which can be formed both in a stationary manner, for example, as a slot nozzle running along a direction of transport 39*a*, or it can run along a transport section with containers 1. Also indicated schematically are transport devices 39 which move container 1 in the direction of transport 39*a*.

The method according to the invention for shaping the bottom is preferably performed before and/or during active recooling of closed containers 1. Transportation of containers 1 is then possible at an early stage in inner state 7 and in particular with bottoms 3 completed shaped. This can reduce transport problems that might otherwise occur due to an interim deformation of containers 1. In addition, bottom 3 exhibits less rigidity in the hot state, so that lower fluid pressures are necessary for performing the method than with containers 1 completely recooled.

In principle, however, shaping the bottoms by way of pressurized fluid 4 would also be conceivable after recooling the containers, for example, in the region of labeling machine 27.

The method according to the invention can be used as follows:

Containers 1 are preferably provided by a stretch blow molding machine (not shown) as a continuous product stream and are preferably so-called panel less containers or panel less bottles. This means, containers 1 then have no compensation surfaces on their side walls provided for vacuum compensation.

Containers 1 are preferably supplied to filler 21 as a continuous product stream using an air conveyor or the like. Containers 1 are hot-filled with product 9 in filler 21 at a product temperature of preferably at least 85° C., in particular from 85 to 92° C.

Subsequently closed containers 1 are transported into the region of neck sterilizer 25 substantially at the filling temperature of product 9. Containers 1 are therein taken to preferably a lying orientation 31 or positioned upside down to sterilize neck portion 1*b* of the containers with the still hot product 9.

The transportation through neck sterilizer 25 can either be carried out at an even transport speed or intermittently. For example, it would be conceivable to direct a fluid jet 4 and/or a fluid pressure wave 35 onto bottom 3 in the region of neck sterilizer 25 when container 1 is stationary and to transport container 1 before and/or thereafter at a transport speed that is increased relative to a mean transport speed of transport sections 24. This simplifies the action upon bottoms 3 with fluid jet 4 and/or with fluid pressure wave 35. However, it would also be conceivable to move at least one pressurized fluid source 5 and/or one shock wave generator 36 or a similar pressure wave generator through a transport section along with containers 1 and to then direct fluid jet 4 and/or fluid pressure wave 35 onto bottoms 3.

After neck sterilization of containers 1, they are forwarded to container recooler 26. Containers 1 can there be returned to an upright orientation 2. Alternatively or in addition to shaping the bottom in neck sterilizer 25, shaping the bottom can be done in container recooler 26.

For this purpose, for example, a fluid jet 4 in the form of cooling water is directed onto bottoms 3. A transport section can also be formed in container recooler 26 in which containers 1 are stationary and/or transported slower when shaping the bottom than their average transport speed through production system 20. Faster transport sections for compensation are then to be formed accordingly upstream or downstream of the region where the bottom is shaped.

For shaping bottoms in recooler 26, several nozzles 5*a* or the like can be formed successively in the direction of transport 11*a*, 13*a* to emit fluid jets 4. They are then activated cyclically, for example, as soon as a container 1 traverses the region of a nozzle 5*a*. It would also be conceivable to move individual nozzles 5*a* with associated bottoms 3 substantially at the respective transport speed. For this purpose, oscillating supports for nozzles 5*a* could be formed.

Recooled containers 1 are preferably transported downstream with completely shaped bottoms 3, i.e. in shaped state 7, for further processing. Subsequent to the recooling of the containers, containers 1 are labeled and/or have prints applied, for example, in labeling machine 27.

Due to the recooling of the containers and the shaping of the bottoms, containers 1 have a shape that is for further processing both mechanically stable and intended for use. This minimizes possible problems during transportation and further processing of containers 1.

With the aid of the fluid-induced shaping of the bottom, it would also be possible to generate a predetermined overpressure in the completed shaped containers 1 in order to additionally stabilize containers with particularly unstable side walls for further processing and/or use. For this purpose, the compensatory reduction in volume AV can be predetermined by suitable shaping and size of region 3*a* to be activated.

The compensatory shaping of the bottom according to the invention by way of pressure fluid jet 4 and/or fluid pressure wave 35 is particularly gentle on the material and eliminates the need for punches and actuating mechanisms to be adapted to bottoms 3.

Fluid jets 4 and/or fluid pressure waves 35 can be used without problems for different bottom shapes and be adapted flexibly to changed stiffness or other mechanical properties of bottoms 3. Likewise, mechanical damage when shaping the bottom can be easily prevented.

The invention claimed is:

1. A method for shaping a bottom of hot-filled and closed containers, where said bottoms of said containers are forced inwardly from a quasi-stable state bulged outwardly, which is dimensionally stable without the action of an external overpressure onto said bottom, and in which the bottoms are bulged outwardly only to such an extent that the bottles can stand on a transport device, wherein said bottoms are forced inwardly by at least one fluid jet and/or a fluid pressure wave, where said bottoms are forced inwardly by a jet of water.

2. The method according to claim 1, where said bottoms are forced inwardly by a jet of compressed air.

3. The method according to claim 1, where said fluid jet and/or said fluid pressure wave are directed onto said bottoms when said containers are in an upright orientation.

4. The method according to claim 3, where said fluid jet and/or said fluid pressure wave are directed onto said bottoms when said containers are being transported.

5. The method according to claim 1, where said containers are fixed by an axial abutment during an action of said fluid jet and/or said fluid pressure wave being directed onto said bottoms.

6. The method according to claim 1, where said fluid jet and/or said fluid pressure wave are directed onto said bottoms in a region of a neck sterilizer.

7. The method according to claim 1, where said fluid jet and/or said fluid pressure wave are directed onto said bottoms in a region of a container recooler.

8. The method according to claim 1, where said containers are panel less bottles made of plastic material.

9. The method according to claim 1, where shaping said bottom causes a reduction in volume (AV) of said container and thereby compensates negative pressure in said containers by at least 50%, which is induced by said hot-filled containers being closed and cooling down.

10. The method according to claim 9, wherein negative pressure in said containers is compensated by at least 75%.

11. The method according to claim 1, wherein said hot-filled containers are forced inwardly from the quasi-stable state bulged outwardly when cooling down.

12. The method according to claim 1, wherein the jet of water is a jet of cooling water.

13. A method for shaping a bottom of hot-filled containers, where said bottoms of said containers are forced inwardly from a quasi-stable state bulged outwardly, which is dimensionally stable without the action of an external overpressure onto said bottom, wherein said bottoms are forced inwardly by at least one fluid jet and/or a fluid pressure wave, where said bottoms are forced inwardly by a shock wave.

14. A method for shaping a bottom of hot-filled containers, where said bottoms of said containers are forced inwardly from a quasi-stable state bulged outwardly, which is dimensionally stable without the action of an external overpressure onto said bottom, wherein said bottoms are forced inwardly by at least one fluid jet and/or a fluid pressure wave, where said at least one fluid jet and/or said fluid pressure wave are directed onto said bottoms when said containers are in a lying orientation.

15. The method according to claim 14, where said at least one fluid jet and/or said fluid pressure wave are directed onto said bottoms when said containers are being transported.

16. A method for shaping a bottom of hot-filled containers, where said bottoms of said containers are forced inwardly from a quasi-stable state bulged outwardly, which is dimensionally stable without the action of an external overpressure onto said bottom, wherein said bottoms are forced inwardly by at least one fluid jet and/or a fluid pressure wave, and where said fluid jet and/or said fluid pressure wave are directed onto said bottoms when said containers are transported upside down.

* * * * *